US010625317B2

(12) United States Patent
Seidel et al.

(10) Patent No.: US 10,625,317 B2
(45) Date of Patent: Apr. 21, 2020

(54) METHOD FOR PRODUCING METAL STRIPS

(71) Applicant: SMS group GmbH, Düsseldorf (DE)

(72) Inventors: Jürgen Seidel, Kreuztal (DE); Uwe Baumgärtel, Hilchenbach (DE); Ralf Wachsmann, Siegen (DE)

(73) Assignee: SMS group GmbH, Düsseldorf (DE)

( * ) Notice: Subject to any disclaimer, the term of this patent is extended or adjusted under 35 U.S.C. 154(b) by 351 days.

(21) Appl. No.: 15/558,020

(22) PCT Filed: Mar. 15, 2016

(86) PCT No.: PCT/EP2016/055525
§ 371 (c)(1),
(2) Date: Nov. 13, 2017

(87) PCT Pub. No.: WO2016/146621
PCT Pub. Date: Sep. 22, 2016

(65) Prior Publication Data

US 2018/0056349 A1 Mar. 1, 2018

(30) Foreign Application Priority Data

Mar. 16, 2015 (DE) ..... 10 2015 204 700

(51) Int. Cl.
*B21B 37/28* (2006.01)

(52) U.S. Cl.
CPC ..... *B21B 37/28* (2013.01); *B21B 2263/02* (2013.01)

(58) Field of Classification Search
CPC ..... B21B 37/28; B21B 2263/02
See application file for complete search history.

(56) References Cited

U.S. PATENT DOCUMENTS 4,070,887 A * 1/1978 Hankin ..... B21D 5/10 228/17.5
5,430,642 A * 7/1995 Nakajima ..... B21B 37/28 700/149

(Continued)

FOREIGN PATENT DOCUMENTS

DE 19851554 A1 5/2000
EP 0618020 B1 6/1997
EP 1481742 A2 12/2004

OTHER PUBLICATIONS

Malik, Arif S., and Ramana V. Grandhi. "A computational method to predict strip profile in rolling mills." Journal of Materials Processing Technology 206.1-3 (2008): 263-274. (Year: 2008).*

(Continued)

*Primary Examiner* — Michael D Masinick
(74) *Attorney, Agent, or Firm* — Maier & Maier, PLLC

(57) ABSTRACT

A method for producing metal strip in a rolling mill, so that as a result of a more accurate manufacturing of metal strips in the future, a more precise forecasting of the profile contour of the metal strip can be obtained over the width of the metal strip, as well as a more precise setting of the profile actuator of the rolling mill. A forecast value is calculated for the profile contour within the context of the simulation of the rolling process before the rolling of the metal strip. In contrast to that, the calculation in the simulation is not conducted prior to the rolling, but instead it is obtained by a post-calculation after the rolling of the metal strip has been carried out.

24 Claims, 7 Drawing Sheets

(56) References Cited

U.S. PATENT DOCUMENTS

Figure 1:
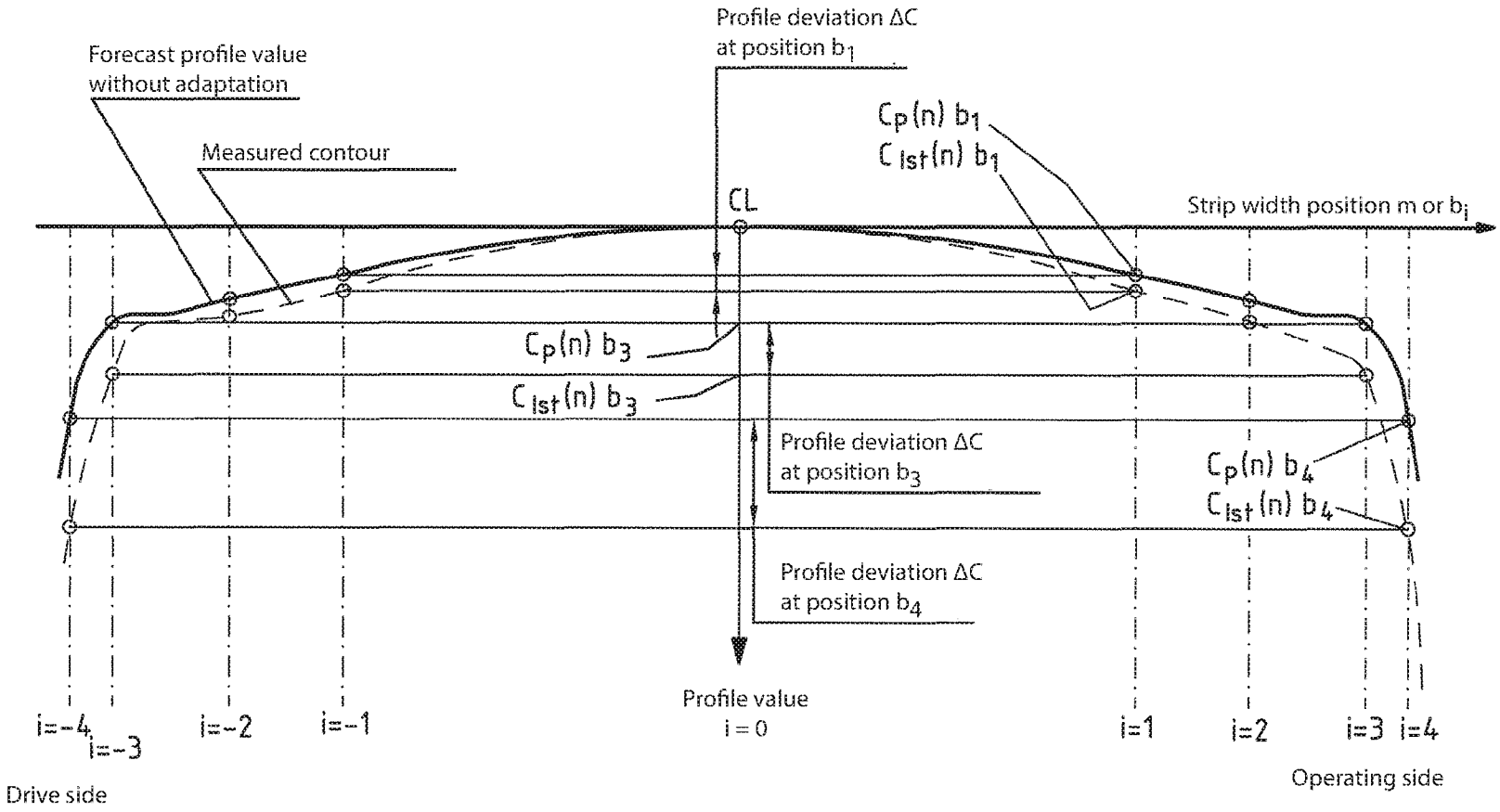

| | | | | |
|---|---|---|---|---|
| 5,622,068 | A * | 4/1997 | Sjoberg | B21D 28/06 72/14.8 |
| 5,768,927 | A * | 6/1998 | Kajiwara | B21B 13/023 72/10.1 |
| 5,927,117 | A * | 7/1999 | Zhang | B21B 37/28 72/11.7 |
| 7,185,519 | B2 * | 3/2007 | Clark | B21B 37/28 72/11.7 |
| 7,363,791 | B2 * | 4/2008 | Bodnar | B21D 28/36 72/190 |
| 2004/0221635 | A1 * | 11/2004 | Bauder | B21C 37/02 72/192 |

OTHER PUBLICATIONS

International Search Report dated Jun. 2, 2016, in connection with the application No. PCT/EP2016/055525 (English verison, 2 pages).
International Search Report dated Jun. 2, 2016, in connection with the application No. PCT/EP2016/055525 (German language only, 5 pages).
Written Opinion by German Patent Authority dated Jun. 2, 2016, in connection with the application No. PCT/EP2016/055525 (German language only, 5 pages).

* cited by examiner

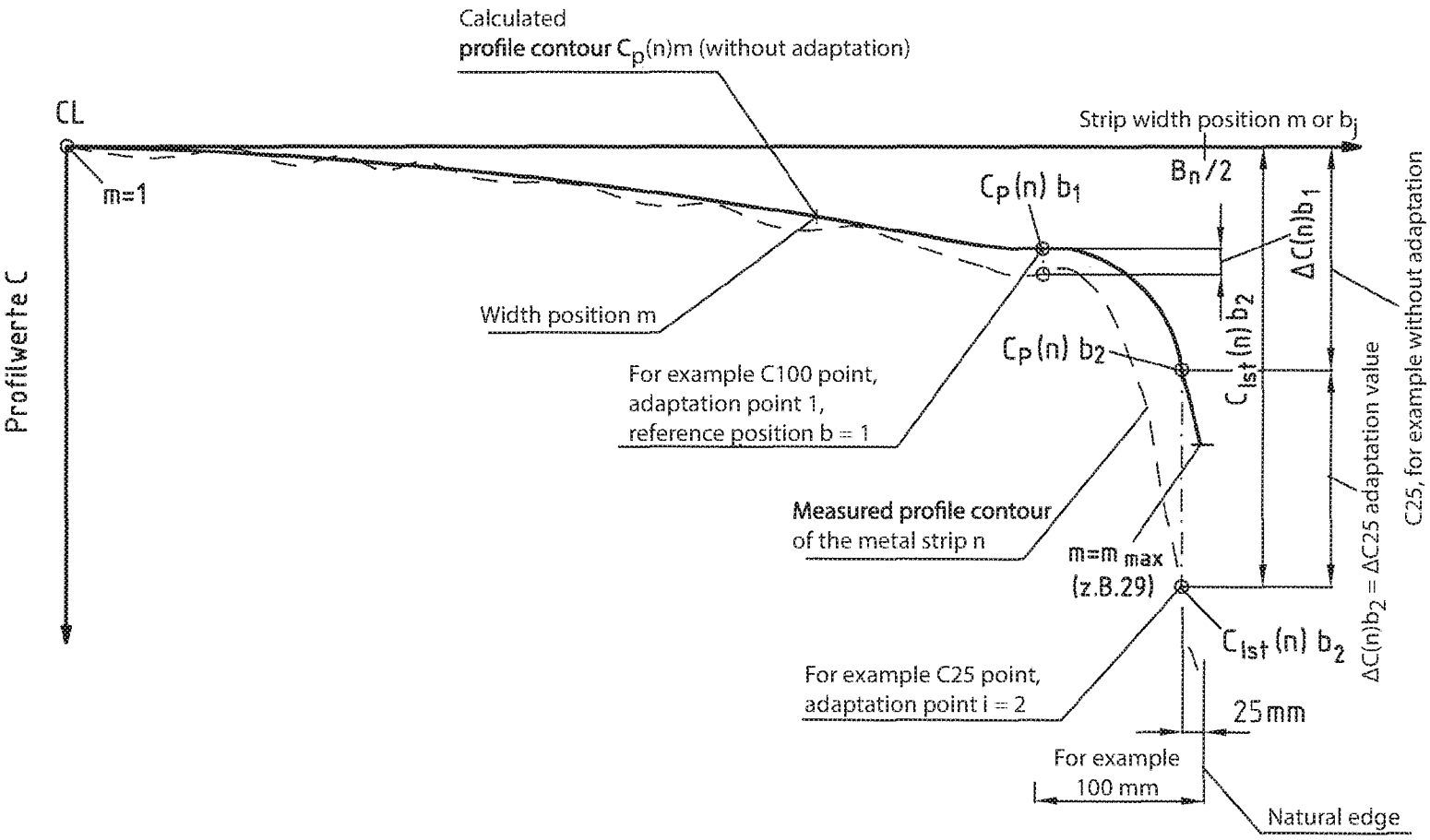
FIG.2.1

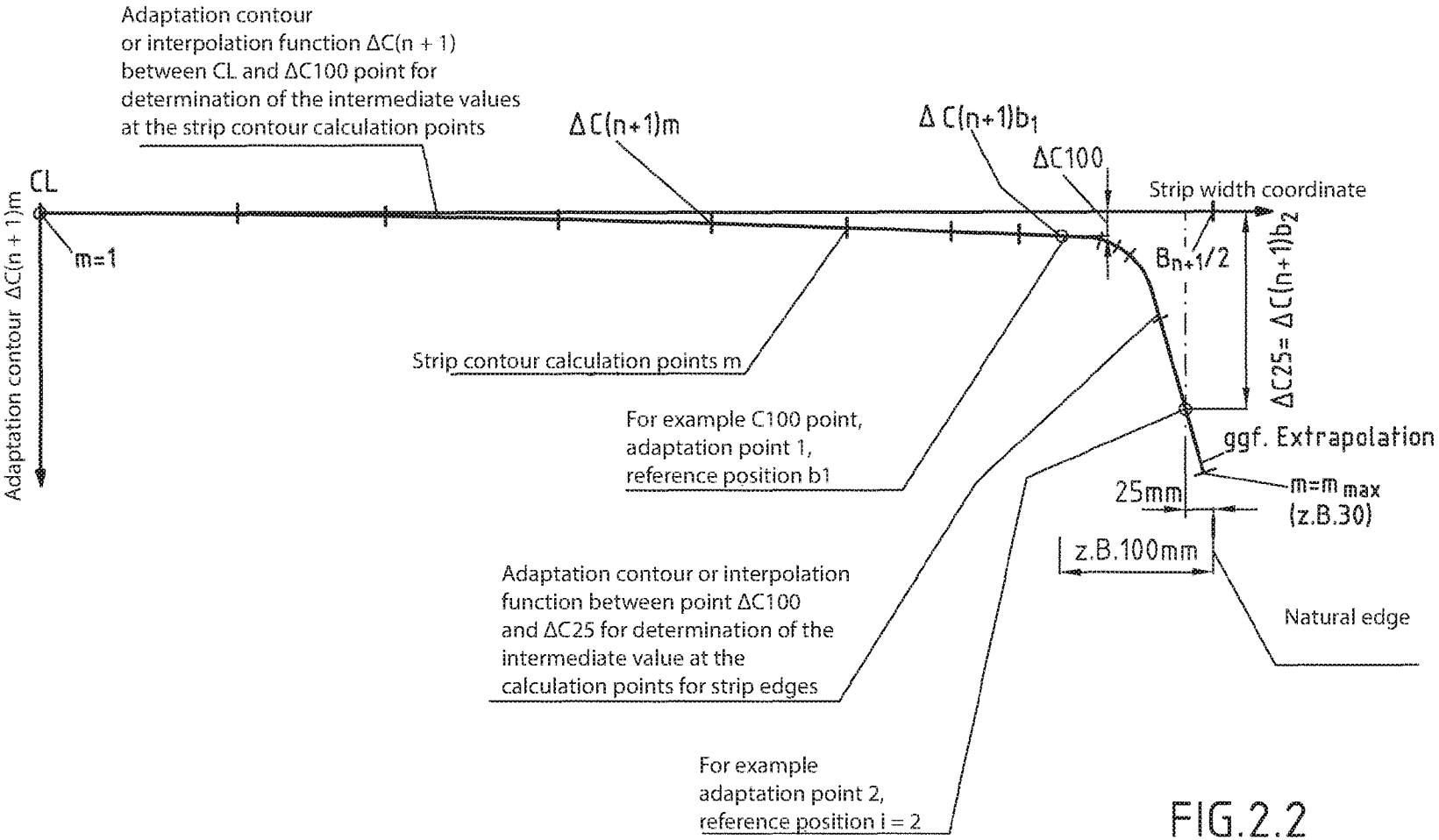
FIG.2.2

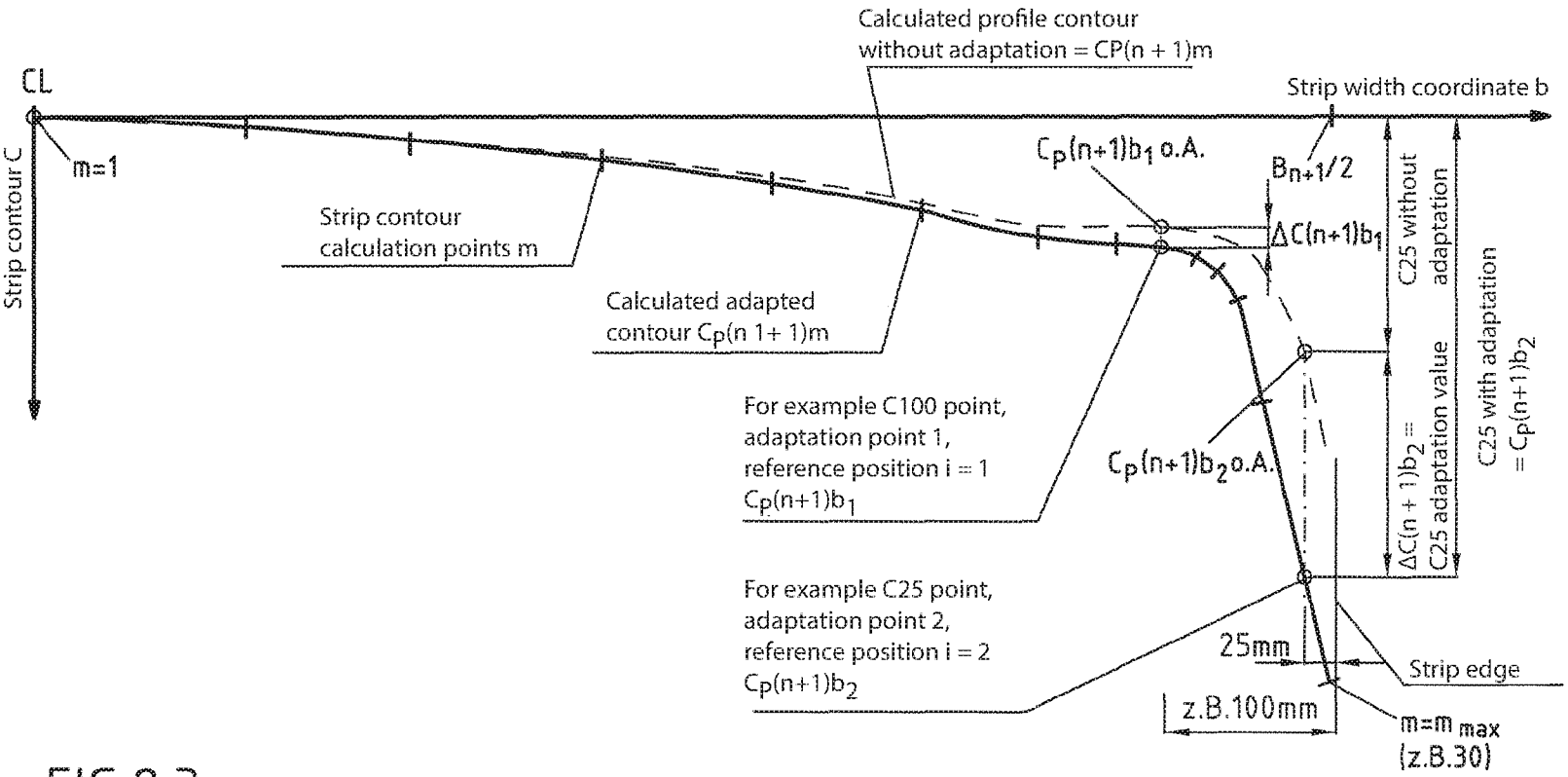
FIG.2.3

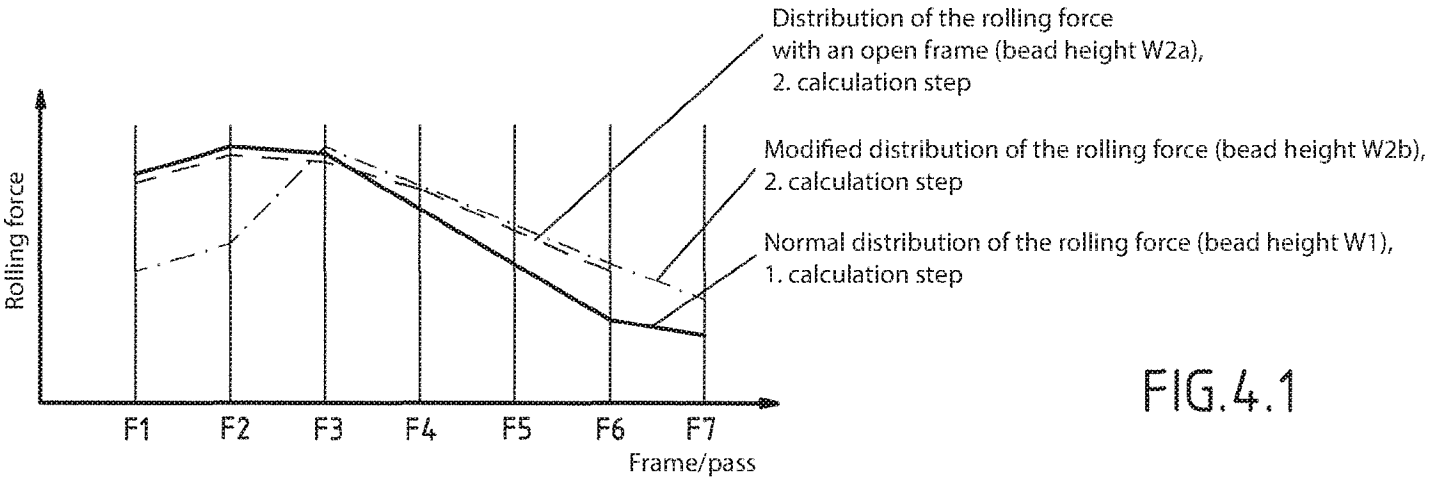
FIG. 4.1
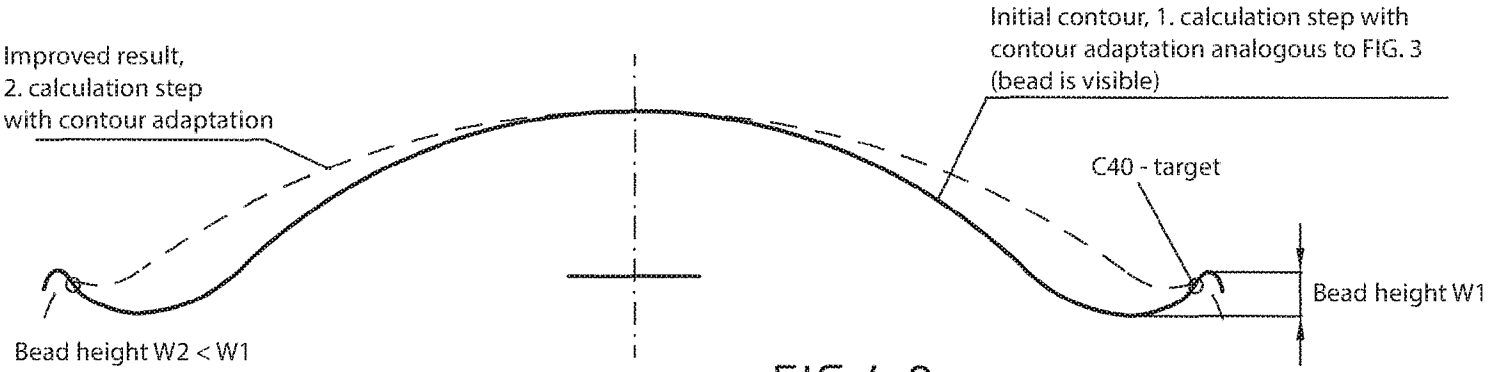
FIG. 4.2

METHOD FOR PRODUCING METAL STRIPS

FIELD

The invention relates to a method for producing metal strips in a rolling mill with a desired profile contour.

BACKGROUND

The background of the present invention is the fact that the requirements on the setting accuracy of the profile of a metal strip, at least in predetermined strip width positions or so called reference positions, are constantly being increased, as are the requirements on the dimensional accuracy of the profile contour of the metal strip. Depending on the intended field of application for a metal strip, for example warm profile contours provided with a parabolic shape are expected to have a predetermined profile height in a predetermined reference position in order to simplify further processing downstream in a cold rolling mill (tandem line). As an alternative, box profiles may be also required, which is to say that metal strips with a flat cross-section in the center are required which is decreasing towards the band edges; this requirement is applicable for example to strip profiles are later to be divided in the longitudinal direction. On the other hand, concave strip profiles, in particular strip profiles having thicker or raised edges in comparison to their central region, or metal strips with an edge bead, are usually not desirable.

In order to make it possible to produce profiles that are as precise as possible, several approaches have been already proposed according to prior art.

So for example, the International Patent Application WO 1995/034388 discloses a detection system for detecting the profile of a metal strip at the exit of a finishing rolling line. The strip profile K detected therein is compared to a predetermined target profile and the use of profile actuators is proposed in order to minimize deviations of the measured profile from the subsequent strips.

Furthermore, a decision is also made as to whether the measured band profile form is acceptable or not, and other measures are proposed, for example a measure to change the thermal crown form of the working rollers in order to improve the profile form as required.

Document EP 0 618 020 B1 also aims to adapt the profile of a metal strip at the exit of a hot rolling strip line to a predetermined target contour. Mechanical actuators are used for this purpose so that a potentially determined deviation between a calculated, which is to say a projected strip form and a predetermined target contour is minimized. Also, a measured strip profile C40 is used (in the position 40 mm from the strip edge), in order to correct or set the control system.

Accordingly, a forecast value for the strip is provided and the setting values for the profile actuators during the rolling of an nth metal strip in a predetermined reference position are simulated and calculated with the aid of a mathematical and physical process model. The simulation is optionally carried out by taking into account the restrictions and the application of different profile actuators. After the rolling of the nth metal strip has been carried out, an adaptation value is calculated based on the difference between said forecast value and a measured actual value of the strip profile of the nth metal strip in said reference position. The reference position is measured at a predetermined strip width position from the natural edge of the metal strip, corresponding for example to 25 or 40 mm According to prior art, said forecast value and said adaptation value are determined or predetermined only with only a single reference position in order to define on this basis individual specifications for the strip profile.

SUMMARY OF THE INVENTION

Based on the existing state of technology, the object of the invention is thus to further develop a known method for producing metal strip in a rolling mill, so that—as a result of a more accurate manufacturing of metal strips in the future—a more precise forecasting of the profile contour of the metal strip can be obtained over the width of the metal strip, as well as a more precise setting of the profile actuator of the rolling mill.

Based on an exemplary embodiment, the forecast value is calculated for the profile contour within the context of the simulation of the rolling process before the rolling of the metal strip. In contrast to that, the forecast value according to an exemplary embodiment, the calculation in the simulation is not conducted prior to the rolling, but instead it is obtained by means of a post-calculation after the rolling of the metal strip has been carried out.

In other words: an alternative can be provided wherein during the calculation of the adaptation value, the value of the profile is calculated by using a simulation of the rolling process that is carried out by using the preset values (expected rolling force, etc.), or with the result of a post-calculation by using the actual conditions (measured rolling force, etc.)

Essentially, an attempt is made according to both methods to match the calculated forecast values with the predetermined target values; although due to process-characteristics factory-specific characteristics, the forecast value may not coincide precisely with the target value, but match the target values only approximately.

The calculation of the forecast values for the strip profiles in different reference positions bi is carried out by using the same setting of the profile actuators. This is true in both claimed methods.

The term a "metal strip" also includes "sheet metal".

The term "rolling mill" includes both individual frames, for example heavy plate frames, plug-in frames or twin plug-in frames, etc., but also an entire finishing rolling mill line.

The term "reference position bi" preferably denotes a substitution of the general position m in the width direction of the metal strip. While strip positions are normally defined by the respective distance from the center of the metal strip in the width direction, reference positions are defined by a respective predetermined distance from the edge of the strip, or from the natural edge of the metal strip. For standardized reference positions, for example 25 mm, 40 mm or for another reference position, for example 100 mm from the natural edge of the metal strip, the values are typically predetermined for the profile contour, for example as C25, C40 or C100 values. The reference positions are preferably identical for different strip widths or for all metal strips. Whether the C . . . values are the target values, forecast values or adaptation values is determined depending on the context.

The term "process model" means a mathematical/physical model for the simulation of a rolling process. In particular, it is possible to calculate in a suitable manner the forecast values and profile contours for the metal strip, as well as the setting values for the profile actuators. The process model is referred to as "Profile Contour and Flatness Control, or PCFC.

The term "calculated value" means "forecast value". Similarly, "calculated value" means "forecast value".

The terms "later manufacture" of "future manufacture" mean manufacturing or rolling at a point in time after the determination of the new adaptation values of at least the nth metal strip. Later manufacture can relate to other longitudinal sections of the same metal strip, or to a completely new metal strip n+x to be manufactured.

The term "n+x" with x=1, 2, 3, . . . etc., x∈n refers to a metal strip manufactured or to be manufactured in the future according to the nth manufactured metal strip, in particular a metal strip to be subjected to rolling treatment.

The respective strip to be subjected to rolling in the future is generally used for corresponding preset calculation referred to with n+x. The previously calculated adaptation values are thus used in this manner.

The terms "profile contour" and "strip contour" are considered in the direction of the width of the metal strip and both are used with the same meaning.

The core idea of the present invention according to the claims is that an adaptation value is determined as a difference between a measured actual value and a calculated value, which is to say forecast value for the profile contour of the metal strip, and not only, as was customary up until now according to prior art, at only one predetermined reference position (numerical value), but at a plurality of reference positions. This plurality of adaptation values determined via a strip width can be taken into account and for the setting of the profile actuators and during the calculation of the profile contour, or for the calculation of the forecast value for metal strips to be processed by rolling in the future. Because multiple adaptation values are provided and thanks to more accurate information about the profile contour, the profile contours can be set in an advantageous manner with more precision with respect to the desired target values for a wide, longitudinal section of the nth metal strip, or for the profile contour of the n+xth metal strip, or for the profile contour for metal strip to be processed by rolling in the future.

Also, the calculation of the forecast values for the profile contour can thus be set more precisely for the n+xth metal strip for metal strips to be processed by rolling in the future.

According to an advantageous embodiment, a distinction is made between short-term adaptation values and long-term adaptation values in the reference points. This makes it possible to use with at least one strip n the same profile contour values for a strip to be subjected to the rolling treatment in the future, because the same profile contour deviations frequently occur again between the measured and the forecast profile curve value under similar conditions also with the next strip, or with a strip to be processed with the rolling treatment in the future.

The calculation of the short-term adaptation values is conducted according to the following formula:

$$\Delta C(n)bi=\Delta C_K(n)bi=\Delta C_K(n-x)bi+[C_{actual}(n)bi-C_P(n)bi]$$

wherein K: short-term adaptation, and $=\Delta C_K(n-x)bi$: old short-term adaptation value $C_{actual}(n)bi$: measured actual value of the profile contour of the nth strip $C_P(n)bi$: calculated forecast value or calculated strip profile x=1, 2, 3 . . .

n: the metal strip in question

When this formula is used for the short-adaptation value, the summand $\Delta C_K(n-x)bi$ is preset at the start of a new rolling process, for example after the working roll is changed, for example to 0 or to another typical initial value. The short-term calculation value is then calculated as the sum from the initial value and the difference between the actual value $C_{actual}(n)bi$ for the profile value and for the forecast value $C_P(n)bi$ of the nth metal bar at the reference position bi.

The long-term adaptation value $\Delta C_L bi$ is obtained by carrying out the following steps:

determining the adaptation value by repeating the steps a) through f) at a plurality of reference positions bi of strips of an adaptation group that were subjected to the rolling treatment prior to the n+xth metal strip, and calculating the long-term adaptation value $\Delta C_L bi$ by forming the average values of the adaptation values, or by forming the average values of the difference between the actual values and the forecast values for the profile contour for the plurality of metal strips, each time at a reference position bi.

For the determination of the forecast values CP(n'+x)bi of the metal strip n+x, the long-term adaptation value ΔCLbi is optionally removed from the corresponding adaptation group to which the metal strip n+x belongs.

In other words, the long-term adaptation value is obtained by forming an average value of the total adaptation value (long-term and short-term adaptation value) of j strips which were processed by rolling in the same adaptation value in the past.

The maximum number applied in the past to rolled strips can be for example 100 or 50 and it can be determined freely. The difference per one strip is thus applicable to the long-term adaptation value only to a jth portion. The determined long-term adaptation value can be used with the PCFC preset calculation at the level of 100% only partially, depending on freely definable edge conditions.

The definition and the calculation of the long-term adaptation value $\Delta C_L(n)bi$ may require knowledge of the short-term adaptation value $\Delta C_K(n)bi$. In contrast to that, the short-term value can be used in exceptional cases also by itself.

As an alternative to the long-term or short-term adaptation value, a total value can be also determined for the determination of the setting values of the profile actuators and for the determination of the strip contour at the reference points bi. This total adaptation value is calculated as the sum of the short-term adaptation value and of the long-term adaptation value, in each case at a reference position bi.

The following example illustrates the possible conduct of calculated profile values and measured value, etc., at a reference position from one strip to another at the same long-term adaptation group:

| Long-term adaptation µm | Short-term adaptation µm | Sum adaptation µm | Target profile µm | Preset strip profile µm | Strip profile without adaptation µm | Measured strip profile µm | Adaptation for the next Strip | |
|---|---|---|---|---|---|---|---|---|
| | | | | | | | Short- term µm | Long-term µm |
| −5.0 | 0 | −5 | 40 | 40 | 45 | 53 | 13 | −4.9 |
| −4.9 | 13 | 8 | 40 | 40 | 32 | 44 | 17 | −4.8 |
| −4.8 | 17 | 12 | 40 | 40 | 28 | 41 | 8 | −4.7 |
| −4.7 | 18 | 13 | 40 | 40 | 27 | 40 | . . . | . . . |

According to another embodiment, the determined short-term adaptation values, the determined long-term adaptation values or the determined sum-adaptation values can be used for the calculation of the default of the profile actuators either at 100% or only for a desired part thereof. The desired part can be selected depending on the freely determinable edge conditions. Depending on the selected weighting, for example 33 or 50%, the adaptation effect can be attenuated or smoothed. The change of the short-adaptation value from one strip to another can be limited by a maximum value, for example 10 µm, in order to avoid potentially excessive weighting of the individual measured error. Short-term adaptation values can be dependent on the variables of the oven or on other process variables. The short-term adaptation value refers as a rule to the profile differences of the last strip n.

In exceptional cases, the profile difference can for example relate to the last but one strip. The number n then corresponds to n−1, or in general to n−x in the strip.

The adaptation values calculated according to the invention can be used in an advantageous manner also to determine the adaptation contour of the metal strip, so that the individually available adaptation values are connected with at least one suitable attachment function. The adaptation value can determined by | for the metal strip n+x determined with one adaptation value ΔC(n+x)bi, or the adaptation contour proceeds depending on the attachment function or smoothing function closely to the adaptation values (approximation). An attachment function is thus used for connection of adaptation values, interpolation, smoothing, extrapolation or approximation and it is for example referred to in this manner. Adaptation values are generally available in at least two reference positions bi, and preferably at least one further adaptation contour value is provided at another strip width position m, which is not a reference position. Other strip width locations are typically also provided by the process model. Depending on for which strip width positions the adaptation values are known, the adaptation contour can be determined only over a limited section or region, or it can be determined over the total width of the metal strip. The density or closeness of the known adaptation values can be different in individual regions over the width of the metal strip. The density of the know adaptation values is preferably greater in the edge region of the metal strip, preferably at the reference positions therein, namely greater than in the central region, which is also known as the body region. This is because the requirements on the precision of the profile contour in the edge region are often higher than the requirements for the central region. If in an extreme and special case, each smoothed measurement point that is supplied by the profile measuring device has an adaptation point bi, and the adaptation contour can be determined also without an additional determination of an interpolation function; in this case, the adaptation contour is simply provided in the next sequence of the plurality of adaptation values. However, the maximum number | for the strip width positions, in particular reference positions, is as a rule less than 10.

According to one advantageous embodiment of the invention, said determined adaptation contour for the n+x'th metal strip is added with a calculated profile contour that is forecast by the process model and not adapted in order to obtain in the result an adapted profile contour for the n+x'th metal strip.

The determination of the attachment functions or interpolation functions of the adaptation contour or of the adapted profile contour can be carried out in different ways in different width sections of the metal strip. A first width contour can be for example located in the central width region, and a second width region or other width regions can be for example located in the edge region, also known as the boundary region.

With two width sections which adjoin one another in the width direction, the attachment function, or the adaptation contour, or the adapted profile contour are selected over both width sections in such a way that the progress of the contour can be always differentiated at the boundary between one strip section and another strip section, wherein in particular it has the same gradient. This condition makes it possible to avoid that the contours would have an irregularity at the border between both strip sections; instead, they transit smoothly into each other.

The adaptation contour, or the profile contour adapted over a width section of the metal strip can b extrapolated into an adjacent width section for determining an extrapolated adapted adaptation contour, or an extrapolated profile contour via the adjacent width region, in particular when no adaptation values or measured profile values are known therein.

Said at least one attachment function, or approximation function, or interpolation function for connecting individual adaptation contours or profile contours, or said extrapolation function, can be formed from a linear function, polynomial function of any order, an exponential function, a trigonometric function, a spline function, or from a combination of different functions. The attachment functions or interpolation functions can be also different in different width sections of the metal strip.

Instead of the measured actual value of the profile contour at the reference position bi, an average value consisting of measured actual values at the mirror-like reference positions bi on the right and left half of the metal strip, seen in the rolling direction, can be also used. In this case, the fictive plane, also referred to as the width plane, functions on the half width or width height of the metal strip which extends in the longitudinal direction of the metal strip as a mirror plane.

The adapted profile contour values, or the adapted profile contour can be determined first also only for a half of the strip, for example the strip half on the operating side and subsequently also for the other strip half, for example the half of the strip on the drive side.

The measured actual value of the profile contour can be used as a direct measured value at the reference position bi, or as a value determined via a compensation function over the width, for example a measured value interpolation function, or a smoothed profile measurement can be used.

The measured actual values $C_{actual}$(n)bi of the profile contour can be determined at a defined strip length position over a strip segment length, or over the total length of the strip.

It is advantageous when the profile contour is determined in accordance with the invention with regard to the profile anomalies, such that for example strip beads, which is to say undesirable thickening in the strip edge region, or steep profile dips, in particular in the edge region of the metal strip, are analyzed. The analysis is preferably carried out online with real-time operations. The profile actuators can be then set in a suitable manner in order to actively combat or reduce said profile anomalies in the longitudinal direction of the metal strip or in the case of subsequently rolled metal strips.

Without using the adaptation contour according to the invention, it can happen that the metal strips are calculated with normal profile contours, while strip beads are in reality formed at the edges. The determination of the adaptation contour enabled according to the invention and the determination of a precisely adapted profile contour made possible in this manner thus opens up new possibilities for improved determination of the profile contour. If for example an edge bead height is calculated for a metal strip which is higher than an allowable threshold value, then a value is set automatically by the process model within the scope of the allowable predetermined profile level, for example between C40target$_{min}$ and C40target$_{max}$ of the strip profile level at a distance of 40 mm from the natural edge of metal strip, as a value that is as a rule increased, so that the maximum allowable height of the edge bead will not be exceeded or reduced and/or a targeted application of profile actuators (such as for example shifting of the rollers) is used to minimize the height of the bead.

While using the conduct of the material cross-flow, it is in addition also possible to adjust in two steps the body strip profile, which is to say the profile contour in the central region of the metal strip, and the strip edge profile, which can be adjusted by using the contour adaptation with more precision. Next, the profile actuators in the front region of the rolling mill or of the first passes are set in such a way that the body profile is adjusted. In the second step, the profile actuators are adjusted for the rear frames or for the last passes in such a way that the nominal profile is adjusted also at the strip edge, or so that an overall contour is formed (designed).

A plurality of target profiles can thus be specified for different width positions, all of which are adjusted, or/and all of which are kept or monitored within predetermined limits. For example, an extended process model can be used adjusted as target profile value C25=30 μm in the edge region, or the deviations are minimized and at the same time, the limit for a target profile value in the body strip region is maintained as C100>15 μm.

In the setting strategy, the profile value can be preset in the strip edge region for example to C25, or as an alternative, the body strip profile value can be set for example to C100 as a primary target so that it is preset differently depending on the strip. It is expedient when the strip contour values or strip contours are adapted (as described) at these reference points.

The adapted profile contour function, consisting of $m_{max}$ profile contour values C(n+x)m is preferably analyzed with respect to strip profile anomalies, and the information about the analyzed finished strip contour errors is transmitted by means of the process model, or by means of transmission functions or weighting factors that are not described in detail, for the calculation of the intermediate frame, or of the intermediate pass contours. As an alternative or in addition, the determined adaptation values at the bi positions are transmitted by means of transmission functions or weighting factors, not further described here, for the calculation of the intermediate frame, or of the intermediate pass contours.

The exact quantitative knowledge regarding the location of the strip contour anomalies (the height of the bead, the width of the bead, the edge drop between two defined profile points, for example C25-C100), as well as profile deviations in the central strip region (for example at C100, C125, C150 or C200), thus allow a targeted analysis as to whether the strip contour errors occur at the edge, in the central region, or in both regions. Based on this knowledge, the profile actuators are purposefully iteratively used in a calculation of the profile and planarity in order to avoid or reduce profile anomalies.

The profile actuators can thus be used in this manner, for example as variables of the cooling systems for working rollers, or of the zone cooling or local roller heating for influencing the thermal crown, for shifting the working rollers in connection with roller grinding (special roller grinding for combating strip beads, "anti-bead rollers") or for combating strip edge drops ("tapered rollers"), CVC rollers, CVC rollers with a grind of a higher order, for example of the polynomial nth order, or with trigonometric functions), with strip edge heating, strip zone cooling, working roller bending and/or frames with pair-cross function can be employed.

BRIEF DESCRIPTION

A total of 5 figures are attached to the description, wherein

Figure 3:
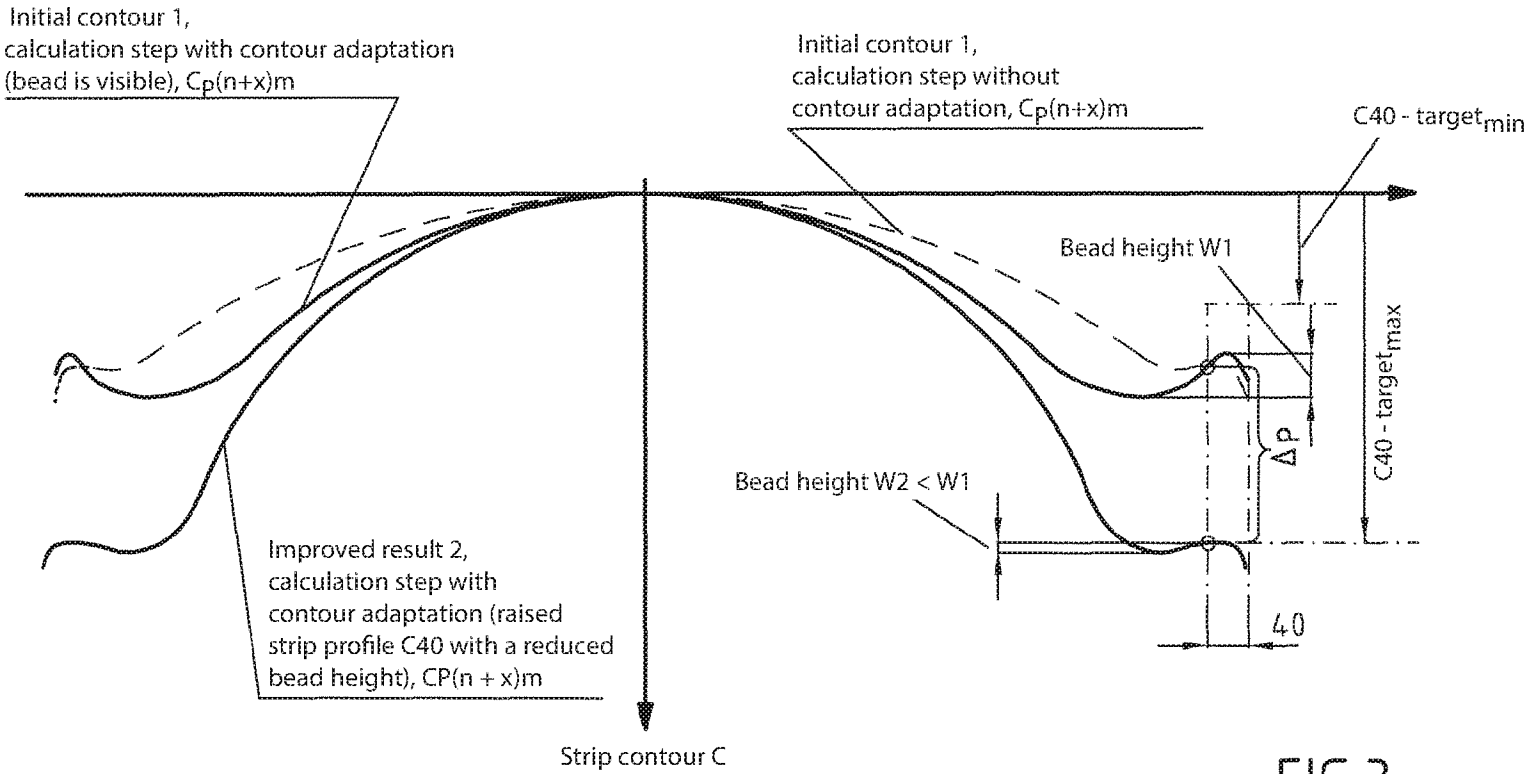
Figure 5:
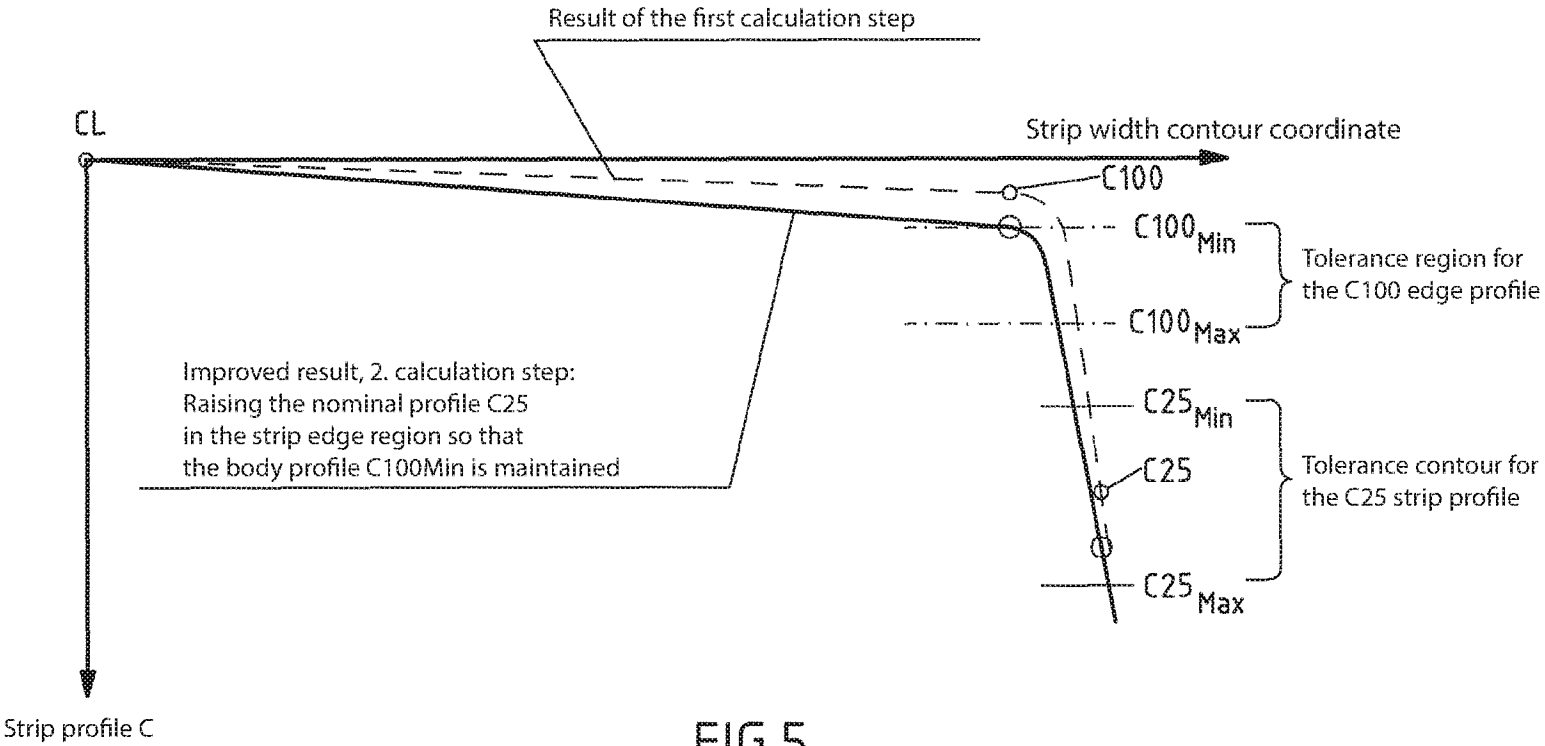

FIG. 1 shows the profile contour of a metal strip used to facilitate understanding of the definition of the essential terms in this invention;

FIGS. 2.1, 2.2 and 2.3 show illustrations of the method according to the invention;

FIG. 3 shows a first possibility for reducing an undesirable bead at the edge of the metal strip profile based on method according to the invention;

FIGS. 4.1 and 4.2 show a second possibility for reducing an undesirable bead at the edge of the metal strip; and FIG. 5 shows the adjustment of the profile contour of the metal strip by presetting a target value at a plurality of reference positions.

The invention will be next described in detail with reference to the figures mentioned in the embodiments.

DETAILED DESCRIPTION

FIG. 1 shows a cross-section, which is to say the profile contour of a metal strip entered into a system of coordinates, wherein the strip width positions m or bi are plotted on the horizontal axis and on the vertical axis is plotted a profile value for the profile contour. The system of coordinates is thus applied to an arched profile contour which has a curved contour in the center of the width. Positive values for the strip width position extend in FIG. 1 to the right and negative values for the strip width position extend in FIG. 1 to the left, each time in the direction of the width of the metal strip.

Individual profile values, which are in each case assigned to concrete positions in the width direction of the metal strip, designate the deviation of the profile contour from the rectangular form of the profile contour, as they are represented by the horizontal axis m/bi. The profile values are therefore offset from the horizontal value perpendicularly downwards and indicated with a positive sign. In other words: the profile values describe in particular the curving of the metal strip at a determined strip position relative to the center of the metal strip. The profile value CL is specified in FIG. 1 with CL=0 because this profile value forms the origin of the coordinate system.

In FIG. 1 can be at first recognized two profile contours, in particular one illustrating a measured profile, represented in FIG. 1 by a dashed line. In addition, the solid line shows for example a forecast profile contour by means of which a process module was calculated. As shown in FIG. 1, the forecast profile contour has not been adapted yet according to the invention as will be described in the following.

The core idea of the present invention is that an adaptation of the forecast profile contour or an adaptation of the profile contour curve, also referred to as $C_P$(n)bi, of the nth metal strip, is in each case applied to a plurality of strip width position bi with i=1, 2, 3, etc., which in FIG. 1 means to the positions bi=b1 through b4. The forecast profile contour corresponds to an aggregation of the calculated profile contour values, or to the profile contour values or forecast values that are mutually interconnected with an interpolation function. Essential for the adaptation according to the invention is the determination of a corresponding adaptation value ΔC(n)bi, which describes the profile deviation, i.e. the difference between the actual value $C_{actual}$(n)bi and the associated forecast value $C_P$(n)bi at the plurality of strip width positions b1 through b4.

In principle, the strip width positions bi are any positions in the width direction of the metal strip; wherein the width positions are normally defined by their positive or negative distance from the center of the strip. However, in some standardized cases, these band width positions can be advantageously also defined by their distance from the respective natural edge of the metal strip at the drive side and/or at the operating side of the metal strip, because in this case they are measured in the direction of the center of the strip. The band width positions that are defined in this manner are typically referred to as reference positions. These standardized reference positions are then typically also assigned concrete profile values, which are then typically referred to for example as C40 or C100.

The numerical indication provided after C then corresponds to the distance of the strip width position from the respective natural edge of the metal strip.

FIG. 1 shows the profile contour over the entire width of the metal strip from the drive side to the operating side. In the subsequent FIGS. 2 and 5 is shown, for simplification purposes, only the right half of the profile contour of the metal strip. The adaptation values or differences determined in this half can be accepted as adaptation value or differences between the forecast and the measured profile contour, at least by means of a mirror-like approximation, also for the left half of the profile contour.

As an alternative, the values measured and calculated for the profile contour are also formed by forming average values of the contour values in the mirror-like positions i=1, i=−1, i=2, i=−2, i=3, i=−3, and/or i=4, i=−4 on the drive or operating side. Negative index values only make it clear that this is the opposite side. It is preferred in this case when the entire measured strip contour is applied in order to suppress potential signal noise or strip contour signals. The calculation of the profile contour and the corresponding adaptation according to the invention can be carried out so that they are symmetrical only for a half of the strip, or asymmetrical for the entire width.

FIG. 2 illustrates the method according to the invention for producing a metal strip or in particular for adaptation of the profile contour of a metal strip.

FIGS. 2.1-2.3 illustrate the circumstances based on a simplified example. Only a short-term adaptation was applied. The purpose of the figures is to illustrate the effect of the contour adaptation on a plurality of the reference points bi, in this case 2 reference points.

FIG. 2.1 in this case first illustrates the determination according to the invention of the adaptation value at an nth metal strip, which is illustrated in a simplified manner only for the right strip half on an example with only two adaptation points. Reference can be made to the previous description of FIG. 1 with respect to the description of the FIG. 2.1; this is also applicable in the same measure to the FIG. 2.1. It should only be mentioned once again that the strip width positions or points in the direction of the width, which is where the calculation of the profile values is carried out, are generally numbered with the parameter m, in particular when the calculation is performed from the strip center CL. Similarly, the reference positions bi are strip width positions, which, however, are not defined from the center of the strip but based on their distance from the natural edge of the metal strip.

The parameter m is used not only in FIG. 2.1, but also in the subsequent figures as a reference to the entire contour or the entire number of contour calculation points. In contrast to the parameter bi, it should be regularly understood as a reference to discrete values (reference positions).

The distances of these reference positions bi from the edge of the strip are the same in FIG. 2.1 and FIG. 2.2, as well as in FIG. 2.3 for the difference strip width n and n+1.

FIG. 2.1 illustrates the determination of individual adaptation values ΔC(n)b1 and ΔC(n)b2 as a difference between individual forecast values $C_P$(nbi) with i=1 and i=2 and the actual values $C_{actual}$(n)bi for the profile contour of the nth metal strip.

FIG. 2.2 illustrates the determination according to the invention of an adaptation contour. The adaptation contour is determined for the next strip n+x. The width of the strip n can be for example different than the width of the strip n+x. Only the adaptation values bi of the strip n or/and the values with the use of long-term adaptation by means of average value formation for a number of strips j are determined and used for the next strip n+x. The adaptation contour and the point sequence ΔC(n+x)m (with the index m) is always used only in connection with the strip n+x.

In FIG. 2.2 and FIG. 2.3 are registered the determined adaptation values ΔC(n)b1 and ΔC(n)b2. They are used therein in a simplified example for the next strip n+x (wherein x=1) for the determination of the adaptation contour. Therefore, the adaptation values above can be also described with ΔC(n+x)b1 and ΔC(n+x)b2 (wherein x=1). In addition to both of these adaptation values at the reference positions b1 and b2, a further trivial value, in this case the value in the center of the bank, wherein m=1 in FIG. 2.2, which is in this case the value in the center of the strip, is also taken into account for the determination of the adaptation contour. The value ΔCL in the center of the strip is ΔCL=0 because the coordinate system has been arranged as passing through this point. The adaptation values were determined at the points b1 and b2 for strip n and for strip n+1 (wherein x−1).

As shown in FIG. 2.2, the adaptation contour ΔC(n+1) for the n+1 metal strip is then obtained as the last attachment or interpolation function, one at a time, via the strip center CL=0 and via the two mentioned adaptation values and at the reference points C100 and C25, wherein both last measured items are measured as a distance from the natural edge of the metal strip.

The formation of an attachment or interpolation function and the interpolation between the center of the strip and the reference point b1, as well as the corresponding formation and interpolation between the reference point b1 and the reference point b2, can be as a rule carried out separately and independently of each other. In order to avoid an irregularity at a transition point of two interpolation functions, for example at the position b1 in FIG. 2.2, the condition for the formulation of both partial interpolation functions is met, namely that it must be possible to continuously differentiate between both of these adjacent partial interpolation functions at the transition point, which is to say that the respective functions must have the same gradients in this position.

This procedure is as a rule carried out for all adaptation regions in the width direction of the metal strip. In this (symmetrical) example, the adaptation contour starts at the strip center CL with a horizontal tangent.

The adaptation contour can be determined by extrapolation from the last adaptation value, in FIG. 2.2 at the reference position i=2, until the end point $m_{max}$ of the metal strip where no profile value is specified. The interpolation or extrapolation is used in order to interpolate or extrapolate based on the predetermined profile value at the reference positions the profile values at other strip width positions m.

FIG. 2.3 illustrates that similarly to the illustration according to the previous FIG. 2.2, the adaptation contour determined for the n+1'th metal strip can be now taken into account for the forecast and subsequent production of the n+n'th metal strip to be processed by rolling.

FIG. 2.3 shows inter alia the calculated adapted profile contour $C_P$(n+1)m as well as the calculated adapted forecast value $C_P$(n+1)b1 and $C_P$(n+1)b2 and a corresponding forecast profile contour $C_P(n+1)m_{OA}$, also shown with dashed lines, with o.a: without adaptation, here as an example for the n+1'the metal strip, which is to say that it is shown here as an example for the next metal strip to be processed by rolling.

The adaptation values ΔC(n)b1 and ΔC(n)b2 previously determined according to FIG. 2.1 for the nth metal strip can be added to the forecast value at the corresponding reference positions in order to obtain improved adaptive forecast values for the forecast adapted profile values or profile contours.

Alternatively or additionally, the adaptation contour ΔC(n+1) determined according to FIG. 2.2 for the n+1'th metal strip previously can be added to the forecast profile contour CP(n+1)mOA determined for the n+1 metal strip in order to obtain a correspondingly improved or adapted profile CP(n+1)m.

The new adapted forecast values obtained in this manner or the new profile contours can be advantageously used in order to set the profile activators during the production of the n+1'th metal strip, generally of the n+x'th metal strip, with an even higher precision with respect to the desired target value or/end target contours.

In mathematical terms, the adapted strip contour values or the adapted strip contour, for example for the n=1'th metal strip to be rolled, can be calculated according to the following formula:

$$C_P(n+1)m_{OA}+\Delta C(n+1)m=C_P(n+1)m$$

wherein $C_P$(n+1)m is the corrected or adapted profile contour of the n+1'th metal strip over the strip width;

$C_P(n+1)m_{OA}$ is a calculated or forecast profile contour of the n+1th metal strip over the strip width m without adaptation;

ΔC(n+1)m adaptation contour: the values of the adaptation contour at the position m for the metal strip n+1;

m=1 . . . $m_{MAX}$.

The width position m can also correspond to the reference positions bi.

The difference or adaptation ΔC(n)m between the measured and the calculated correction is shown in the example indicated in FIG. 2.2 in order to simplify the description/representation only for one metal strip. As a rule, this difference is determined for the metal strip rolled as the last one and/or the last but one and/or for a plurality of metal strips of the same type, or possibly also formed in this manner with a different weighting.

FIG. 3 shows an application field for the use of the contour adaptation according to the invention, or for avoiding undesired beads in the edge region of a metal strip. In this embodiment shown in FIG. 3, the reduction of the bead is carried out with a targeted increase of a value of the profile contour in a reference position, in FIG. 3 it is the position C40, which is to say 40 mm from the natural edge of the metal strip.

Without using the contour adaptation, strips expected to have normal profile contours are calculated or forecast; see the dotted outline contour according to the first calculation step without contour adaptation in FIG. 3. After carrying out the method according to the invention described previously, in particular with reference to FIG. 2.3, for contour adaptation with the addition of a profile contour forecast for the strip n+x and with an adaptation contour determined for a previous strip, the target adapted contour $C_P$(n+x)m according to the invention shown in FIG. 3 can be determined for the n+x'th metal strip. The advantage of the $C_P$(n+x)m adapted according to the invention over the non-adapted forecast profile contour (CP(n+x)$m_{OA}$ can be clearly seen in FIG. 3, because the undesirable bead with the bead height W1 is only recognizable in the adapted profile contour for the first time in the edge region of the metal strip; in the non-adapted forecast profile (dashed line), the bead is not recognizable so clearly. To this extent, the profile adaptation according to the invention provides an improved calculation result for determining a precise profile contour and opens up new possibilities for improving the profile contour, in this case in particular for reducing the height of the bead. If for example an edge bead height W1 is calculated for the metal strip according to FIG. 3, which is greater than a threshold value for an allowable bead height, a process model is calculated within the context of the predetermined allowable limits, for example C40-$target_{min}$ and C40-$target_{max}$ of the profile value at the corresponding strip edge position, in this case at 40 mm from the natural edge of the metal strip, and it is set automatically to a new value, which is increased in this case, so that the allowable height of the bead will not be exceeded or reduced. As a result of said increase of the predetermined profile, the amount of the example of the bead height shown in FIG. 3 is reduced by the amount ΔP from W1 to W2.

Alternatively or additionally, for the same conditions and the same profile contours as shown according to FIG. 3, with the use of adapted profile contours for controlling the bead height, an increased force level is achieved within the context of the process and facility limits in the rear frames of a finishing line, or with a reversing frame in which subsequent rear passes are used. The can be achieved with a distribution of the rolling force, i.e. by relieving the front frames or the earlier passes and with a stronger load on the rear frames or subsequent passes and/or by moving up one frame or a plurality of frames (the latter frame or the letter passes of the frame in the rolling line or the central pass). FIG. 4.1 shows examples of an advantageous rolling force distribution that is used in order to reduce the bead height W1 (see FIG. 4.2). With an iteratively determined higher load in the rear frames, the flattening output of the processing rollers is increased, see the dashed line in FIG. 4.2 (2. calculation step). The mechanical profile actuators are in the iterative calculation process adjusted to these new edge conditions and set for example for a C40 target profile.

The knowledge of the profile contour that can be expected as a result of physical modeling of the relevant conditions and of the adapted profile contour at a plurality of positions bi is further actively used over the width of the metal strip in order to adjust a nominal strip profile at the edge of the strip, for example at the position C25, additionally also to the strip profile in the central region of the strip—expressed by C body or C100—and maintained within allowable minimum and maximum limits $C100_{min}$, $C100_{max}$, as shown in the example of FIG. 5. With progressive profile presetting, additional process limits are advantageously introduced and the minimum and maximum profile limits are taken into consideration for a plurality of strip contour points, such as for example C25 and C100. The improved result (2. calculation result) is represented by the strip contour with the solid line.

The invention claimed is:

1. A method for producing metal strips in a rolling mill with a desired profile contour, comprising the following steps:

a) presetting a target value for the profile contour for at least one reference position bi in the width direction for at least one n'th metal strip;

b) simulating a rolling process on a rolling line for producing the metal strips with the-aid of a process model, wherein setting values for profile actuators and a forecast value $C_P$(n)bi for the profile contour of the n'th metal strip are calculated at the reference position bi that is as close as possible the target value, the calculated setting values taking into consideration old adaptation values ΔC(n−x)bi based on a difference between an old measured actual value $C_{actual}$(n−x)bi for the profile contour and an old forecast value $C_P$(n−x) calculated for the profile contour of the n'th metal strip at the reference position bi and with potential restrictions with respect to the profile actuators;

c) setting the profile actuators with the calculated setting values;

d) rolling the n'th metal strip;

e) measuring an actual value $C_{actual}$(n)bi of the profile contour of the rolled n'th metal strip at the reference position bi; and f) determining a new adaptation value ΔC(n) bi based on the difference between the actual value $C_{actual}$(n)bi measured in step e) and the forecast value $C_P$(n)bi calculated in step b) for the profile contour of the n'th metal strip at the reference position bi;

wherein the steps a), b) and c) are carried out before the rolling of the at least n'th metal strip for a plurality I, wherein I≥2, of reference positions bi, wherein 1≤i≤I, in at least one width section of the at least n'th metal strip;

wherein the steps e) and f) are carried out after the rolling of the at least n'th metal strip for the plurality I of reference positions bi in order to determine the new adaptation value ΔC(n) bi at the plurality I of the reference positions bi in the at least one width section of the at least n'th metal strip; and g) wherein during a subsequent production of a further longitudinal section of the n'th metal strip or of an n+x'th metal strip, wherein x=1, 2, etc., at least the steps a) through d) are repeated with n=n+x, wherein the new adaptation values ΔC(n) bi determined previously according to step f) at least for the n'th metal strip are taken into account for the plurality I of the reference positions bi during the calculation of the settings for the profile actuator and for the calculation of the forecast values according to step b) for the n+x'th metal strip as old adaptation values.

2. The method according to claim 1, wherein the determination of the new adaptation value ΔC(n)bi according to step f) at the reference positions bi of the n'th metal strip is carried out at least partially as a short-term adaptation value $\Delta C_K$(n)bi calculated according to the following formula:

$$\Delta C(n)bi=\Delta C_K(n)bi=\Delta C_K(n-x)bi+[C_{actual}(n)bi-C_P(n)bi],$$

wherein:

K: short-term adaptation, x=1, 2, 3 . . . ;

$\Delta C_K$(n−x)bi: old short-term adaptation value;

$C_{actual}$(n)bi: measured actual value for the profile contour of the n'th metal strip at the reference position bi; and $C_P$(n)bi: calculated forecast value or calculated strip profile.

3. A method for producing metal strips in a rolling mill with a desired profile contour, provided with the following steps:

a) presetting a target value for the profile contour for at least one reference position bi in the width direction for at least one n'th metal strip;

b) simulating a rolling process on the rolling line for producing the metal strips with the aid of a process model, wherein the setting values for profile actuators are calculated in such a way to obtain a target value is close as possible to the desired profile contour while taking into account all adaptation values at reference positions bi and possible restrictions with respect to the profile actuators;

d) adjusting the profile actuators with the calculated adjustment values;

d) rolling the n'th metal strip;

e) measuring the actual value $C_{actual}$(n)bi of the profile contour of the rolled n'th metal strip at the reference position bi;

e') calculating a recalculated forecast value $C'_P$(n)bi for the profile contour of the n'th metal strip at the reference position bi on the basis of the rolling mill conditions and current processing positions, as present during the rolling of the n'th metal strip according to step d); and f) determining a new adaptation value $\Delta C(n)$ bi based on the difference between the actual value $C_{actual}(n)bi$ and the forecast value $C_P(n)bi$ recalculated for the profile contour of the n'th metal strip at the reference position bi;

wherein the steps a), b) and c) are carried out before the rolling of the at least n'th metal strip for a plurality l, wherein $l \geq 2$, of reference positions bi, wherein $1 \leq l$, in at least one width section of the at least n'th metal strip; wherein the steps e), e') and f) are carried out after the rolling of the at least n'th metal strip for the plurality of reference positions bi in order to determine the new adaptation value $\Delta C(n)$ bi at the plurality of the reference positions bi in the at least one width section of the at least n'th metal strip; and g) wherein during a subsequent production of a further longitudinal section of the n'th metal strip or of an n+x'th metal strip, wherein x=1, 2, etc., at least the steps a) through d) are repeated with n=n+x, wherein the new adaptation values $\Delta C(n)$ bi determined previously according to step f) at least for the n'th metal strip are taken into account for the plurality l of the reference positions bi during the calculation of the settings for the profile actuator and for the calculation of the forecast values according to step b) for the n+x'th metal strip as old adaptation values.

4. The method according to claim 3, wherein the determination of the new adaptation value $\Delta C(n)bi$ according to step f) at the reference positions bi of the n'th metal strip is carried out at least partially as a short-term adaptation value $\Delta C_K(n)bi$ calculated according to the following formula:

$$\Delta C(n)bi = \Delta C_K(n)bi = \Delta C_K(n-x)bi + [C_{actual}(n)bi - C'_P(n)bi],$$

wherein:

K: short-term adaptation, x=1, 2, 3 . . . ;

$\Delta C_K(n-x)bi$: old short-term adaptation value;

$C_{actual}(n)bi$: measured actual value for the profile contour of the n'th metal strip at the reference position bi; and value $C'_P(n)bi$: measured recalculated forecast value or strip profile to be recalculated.

5. The method according to claim 3, wherein the determination of new adaptation value $\Delta C(n)bi$ according to claim f) at the reference positions bi is carried at least partially as long-term adaptation values $\Delta C_L(n)bi$ by carrying out the following steps:

determining the adaptation values by repeating the steps a) through f) at a plurality l of reference positions bi for a plurality of metal strips of an adaptation group processed by rolling before the n+x'th metal strip; and calculating the long-term position values $\Delta C_L(n)bi$ based on average values of the adaptation values, or based on average values of differences between the actual values and forecast values for the profile contour for the plurality of metal strips, in each case at a reference position bi.

6. The method according to claim 2, wherein determination of the adaptation value $\Delta C(n)bi$ according to step f) as a sum adaptation value $\Delta C_S(n)bi$ based on a sum of the calculated short-term adaptation value $\Delta C_K(n)bi$ and long term adaptation value $\Delta C_L(n)bi$ to be used for the metal strip n+x, the long term adaptation value $\Delta C_L(n)bi$ being calculated as average values of the adaptation values or average values of differences between the actual values and forecast values for the profile contour for the plurality of metal strips, in each case at a reference position bi.

7. The method according to one of the claim 6, wherein determination of the adaptation value $\Delta C(n)bi$ according to step f) and/or the use of the adaptation value $\Delta C(n)bi$ as a short-term adaptation value weighted with the weighting factor g, wherein $0 \leq g \leq 1$, or with the weighting function weighted for the short-term adaptation value, long-term adaptation value, or sum adaptation value.

8. The method according to claim 1, wherein determination of an adaptation contour $\Delta C(n+x)m$ for the n+x'th metal strip in the form of an attachment function, which is conducted via an adaptation value determined at the at least one metal strip at at least two reference positions bi and additionally via at least one other calculation point by a calculated/predetermined calculation point from at least one further strip width position m.

9. The method according to claim 8, wherein determination of an adapted profile contour $C_P(n+x)m$ for the n+x'th metal strip by addition of a non-adapted calculated profile contour $C_P(n+x)m_{OA}$ as forecast by the process model for the n+x'th metal strip and the calculation adaptation contour $\Delta C(n+x)m$ for the n+x'th metal strip.

10. The method according claim 8, wherein the determination of the adaptation contour or of the profile contour for ≥2 width sections of the metal strip is carried out, wherein the first width section of the metal strip is located in the central region and the second width section or other width sections are located in the edge region of the metal strip.

11. The method according to claim 10, wherein in the case when two sections adjoin each other in the width direction, the adaptation contour or the adapted profile contour is preferably selected over the two width sections in such a way that the contour courses can be continuously differentiated at the boundary of one strip section to another strip section in that the contour courses have the same gradients.

12. The method according to claim 10, wherein the attachment function is formed over at least one of the width sections from a linear function, a polynomial function, an exponential function, a trigonometric function, a spline function or a combination of different functions.

13. The method according to claim 12, wherein the attachment functions are different for the difference adjacent width sections.

14. The method according to claim 8, wherein the adaptation contour or the adapted profile contour is extrapolated into a neighboring width section over a width section in order to determine an extrapolated adaptation contour or an extrapolated adapted profile contour over the neighboring width region.

15. The method according to claim 1, wherein instead of the measured actual value $C_{actual}(n)bi$ of the profile contour of the metal strip, an average value is used at the reference position bi from the actual value measured at the mirror-like reference position bi on the right and left half of the metal strip—seen in the direction of rolling.

16. The method according to one of the claim 1, wherein the forecast value $C_P(n+x)bi$ or/and the adapted profile contour $C_P(n+x)m$ is first determined for one strip half, the strip half on the operating side, and after that it is mirrored for the other strip half, on the drive side, at the strip center level, which extends in the longitudinal direction.

17. The method according to claim 1, wherein the measured actual value $C_{actual}(n)bi$ of the profile contour is used as a direct measured value at the reference position bi or as a smoothed profile measurement value via an attachment function.

18. The method according to claim 9, wherein the adapted profile contour $C_P(n+x)m$ is analyzed with regard to profile anomalies in an edge region of the metal strip.

19. The method according to claim 18, wherein an anomaly for which the adapted profile contour $C_P(n+x)m$ is analyzed is a thickening in the edge region of the strip, the thickening in the edge region is iteratively improved by the process model by successively increasing a value of the profile contour from at least one of the reference positions bi within the scope of the allowable profile positioning limits and with corresponding new setting of the profile actuators in order to reduce the thickening of the strip at the edge region.

20. The method according to claim 18, wherein an anomaly for which the adapted profile contour $C_P(n+x)m$ is analyzed is a thickening in the edge region of the strip, and the thickening in the edge region is reduced or avoided by increasing the load in a last rolling frame, or in a last rolling frame of a rolling line, or with last rolling passes of a frame in the rolling mill by redistributing the load from the front to the rear, or by deselecting at least one rolling frame or rolling pass within the scope of the process and facility limits.

21. The method according to claim 10, wherein for the production of the n+x'th metal strip, the profile actuators are adjusted in step b) in such a way that the target values predetermined for a plurality of reference positions bi or calculated forecast values $C_P(n+x)bi$ for the profile contour are achieved in minimum or maximum profile boundaries; or the profile actuators are adjusted in such a way in step b) that the target value predetermined for a reference position bi is achieved, or the deviation from the target value is minimal and at the same time, the strip profile is maintained within allowable minimum or maximum profile values from at least one further strip width position.

22. The method according to claim 1, wherein the determined adaptation value at the positions bi and/or the adapted profile contour and/or the adaptation contour in the process model are taken into account, being transmitted to previous rolling passes or frames with weighting factors or transmission functions, for the calculation of the intermediate frame or intermediate contours of the front frames or the preceding passes and for an optimized adjustment of the profile actuators.

23. The method according to claim 1, wherein the reference position bi is defined via a distance from an edge of the metal strip.

24. The method according to claim 1, wherein for the adjustment of the target value, while taking into consideration adaptation values, the following profile actuators are employed: variable processing cooling systems, or zone cooling system, or local roller warming for influencing the thermal crown and/or processing of rolling shifts in conjunction with roller grinding, heating systems for the strip edges, strip zone cooling systems, bending systems for the work rollers and/or frames with rollers provided with the pair cross function.

* * * * *